United States Patent [19]

Tazaki

[11] Patent Number: 4,651,175

[45] Date of Patent: Mar. 17, 1987

[54] PRINTER

[75] Inventor: Shigemitsu Tazaki, Matsudo, Japan

[73] Assignee: Canon Kabushiki Kaisha, Tokyo, Japan

[21] Appl. No.: 796,537

[22] Filed: Nov. 12, 1985

Related U.S. Application Data

[63] Continuation of Ser. No. 553,126, Nov. 18, 1983, abandoned.

[30] Foreign Application Priority Data

Dec. 1, 1982 [JP] Japan ..... 57-210903

[51] Int. Cl.[4] ..... G01D 15/16

[52] U.S. Cl. ..... 346/140 R; 340/730; 358/75; 400/126

[58] Field of Search ..... 346/140, 75; 358/75, 358/78; 340/703, 730; 400/126, 121

[56] References Cited

U.S. PATENT DOCUMENTS

| | | | |
|---|---|---|---|
| 3,683,212 | 8/1972 | Zoltan | 346/140 X |
| 3,911,418 | 10/1975 | Takeda | 340/703 |
| 3,984,828 | 10/1976 | Beyers | 340/703 |
| 4,034,353 | 7/1977 | Denny et al. | 364/200 |
| 4,101,962 | 7/1978 | Hakata | 364/413 |
| 4,184,202 | 1/1980 | McCrae | 364/413 |
| 4,320,406 | 3/1982 | Heinzl | 346/140 |
| 4,403,874 | 9/1983 | Payne | 400/124 |
| 4,408,198 | 10/1983 | Kudirka | 340/730 X |
| 4,476,486 | 10/1984 | Ayata | 358/78 |

FOREIGN PATENT DOCUMENTS

| | | |
|---|---|---|
| 108976 | 7/1982 | Japan . |
| 129760 | 11/1982 | Japan . |

*Primary Examiner*—Joseph W. Hartary

*Attorney, Agent, or Firm*—Fitzpatrick, Cella, Harper & Scinto

[57] ABSTRACT

A multi-color printer prints a graph pattern in which, graph patterns printed in a hard-to-distinguish color are framed by a frame pattern of a different easy-to-distinguish color.

6 Claims, 6 Drawing Figures

FIG. IC PRIOR ART
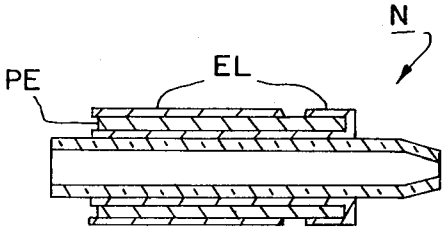
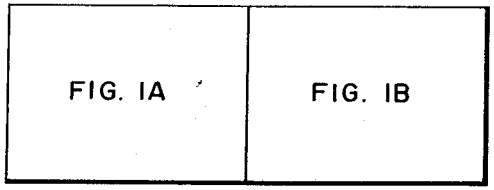
FIG. I
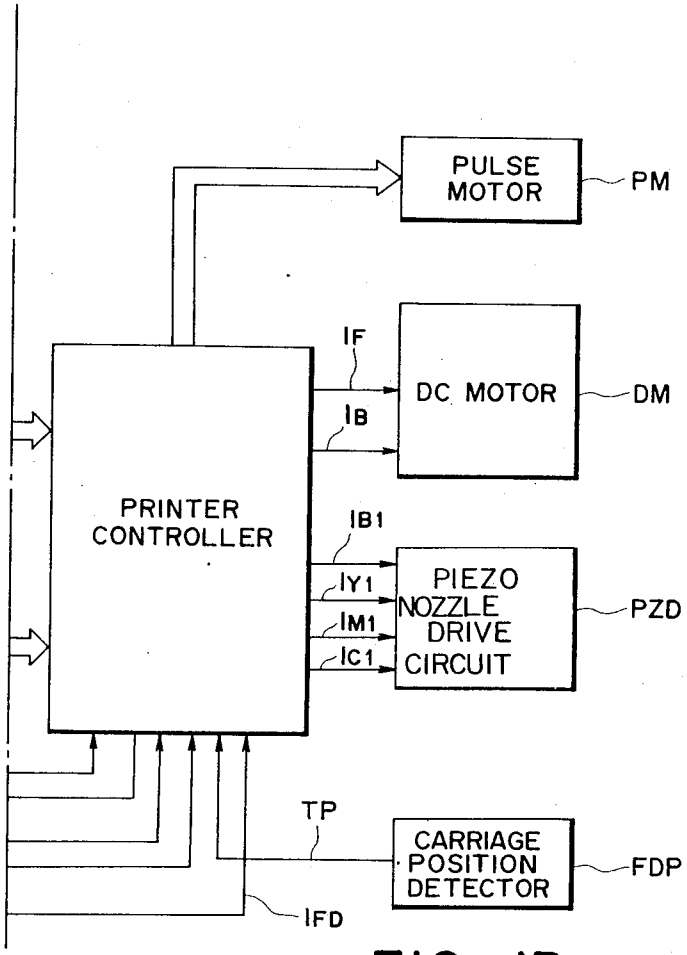
FIG. IB

PRINTER

This application is a continuation of application Ser. No. 553,126 filed Nov. 18, 1983, now abandoned.

BACKGROUND OF THE INVENTION

1. Field of the Invention

The present invention relates to graphic printing in a multi-color printer.

2. Description of the Prior art

It has been a common practice to display a calculation result by a graph in order to facilitate visual recognition the status. Some of office computers, personal computers and desk-top calculators with printers have graph printing functions. Many office computers and personal computers use multi-color CRT displays to display the graphs in a readily recognisable way. Multi-color printers for color-printing the multi-color graphs have been developed.

Usually, red, green and blue are the basic colors used in the CRT display, and yellow, magenta, cyan and white are additionally used to display the graph. However, when a yellow pattern which is clearly visible on the CRT display is printed on white paper, it is very unclear and hard to distinguish. When seven-color printing is made by the printer, cyan, magenta and yellow are used as basic colors and those colors are mixed to print red, green, blue and black patterns. (Sometimes, black ink is separately provided.)

Because the yellow print is hard to distinguish, it may be modified to a color tone which is easier to distinguish. However, the colors which are synthesized by yellow and other colors are affected. Therefore, the color tone cannot be changed significantly and the print remains hard to distinguish. Particularly in the graph printing, a boundary with other color printing is hard to distinguish, or it is hard to determine whether the area is printed or blank.

SUMMARY OF THE INVENTION

It is an object of the present invention to provide a color printer which color-prints a graph with a pattern of a hard-to-distinguish color being encircled by a pattern of other color.

BRIEF DESCRIPTION OF THE DRAWINGS

FIGS. 1A and 1B are a schematic diagram of one embodiment of the present invention, FIG. 1C is a schematic depiction of a conventional ink jet nozzle.

DETAILED DESCRIPTION OF THE PREFERRED EMBODIMENTS

Figure 1A:
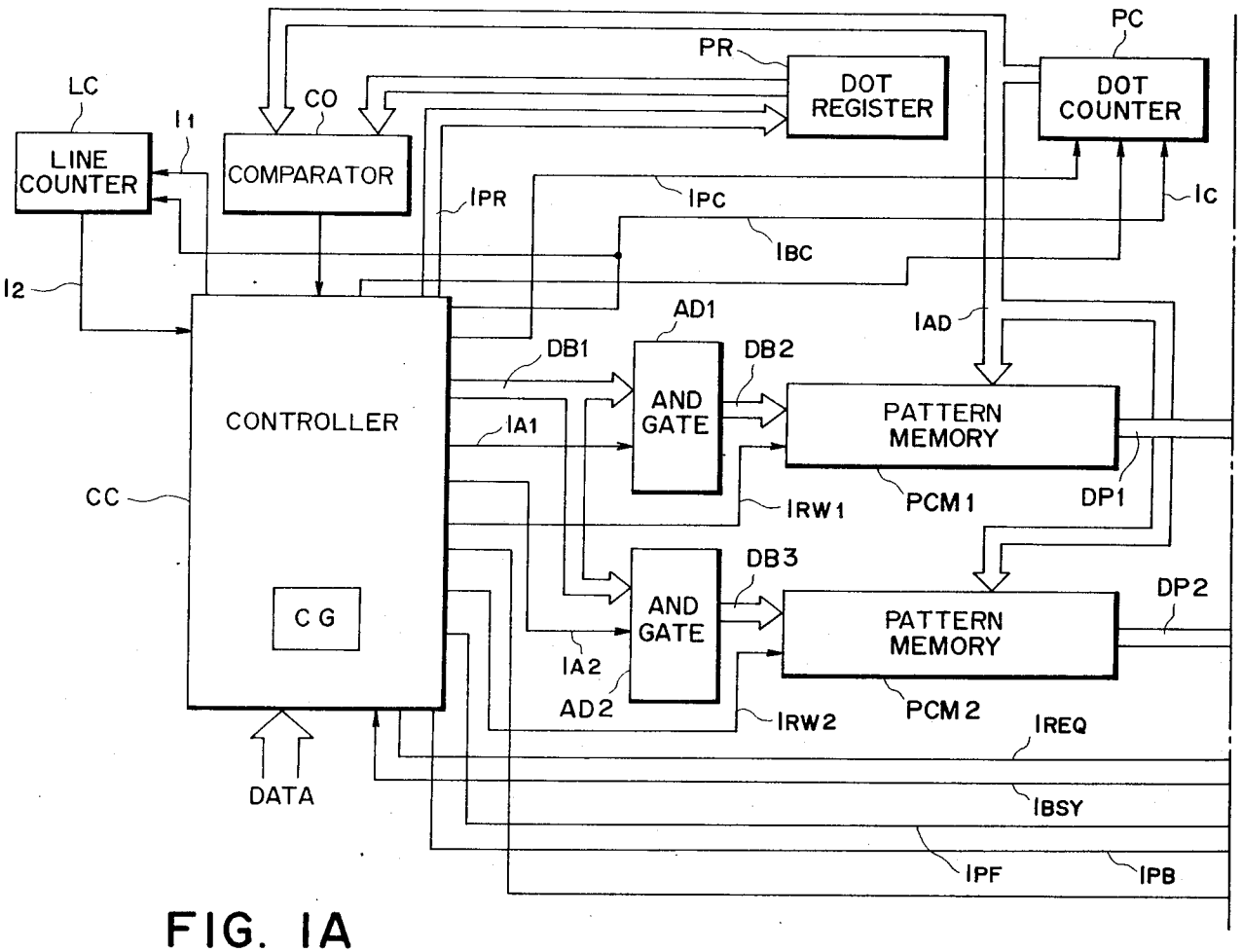

FIG. 1 shows a block diagram of a configuration for printing a bar graph in accordance with input pattern data. Printing a yellow zig-zag pattern graph is explained as an example.

The graph print consists of aggregation of dots, 126 dots horizontal by 7 dots vertical. Pattern memories PCM 1 and PCM 2 in FIG. 1 each has a 126-byte memory capacity with each byte having a 1×7-dot data. In order to print a yellow pattern and a pattern of other color, for example a black framing pattern to provide contrast for the yellow pattern; PCM 1 is used as a yellow pattern memory and PCM 2 is used as a black pattern memory.

When a yellow graph pattern a 50-horizontal dot zig-zag pattern is to be printed, a controller CC discriminates that it is a designated, pattern of a hard-to-distinguish color, that is, which provides low contrast with the color of the recording medium, and stores the graph dot pattern of yellow 50-dot zig-zag pattern as well as a 76-dot space dot pattern in the yellow pattern memory PCM 1, and stores a 51-dot black dot pattern for the frame as well as a space dot pattern, a reference line and a number for identifying an item, for example, "5" in the black pattern memory PCM 2. This is carried out in the following manner. In FIG. 1, a signal $l_{PR}$ is supplied to a dot register PR to set "125" therein and a dot counter PC and a line counter LC are cleared by a signal line $l_C$. An output signal $l_{Ad}$ of the dot counter PC is an address signal to the two pattern memories PCM 1 and PCM 2. A signal line $l_{Al}$ is set to "1" to open an AND gate AD 1 so that a character data on a data signal line DB 1 appears on a line DB 2, a yellow read/write signal line $l_{Rw}$ is set to "0" to write the first dot data of the 50-dot yellow zig-zag pattern in the yellow pattern memory PCM 1. The content of the dot register PR and the content of the dot counter PC are compared by a comparator CO, and if they are not equal, the content of the dot counter PC is incremented by one through the signal line $l_{PC}$ and the next 1×7-dot yellow pattern data is written into the memory PCM 1. The above The above operation is repeated until the contents of the counter PC and the register PR coincide so that the 126-byte yellow pattern data consisting of the yellow zig-zag pattern and the space pattern of the black-framed yellow zig-zag pattern is written into the memory PCM 1. To write the data into the black pattern memory PCM 2, the dot counter PC is cleared by the signal line $l_C$, the signal line $l_{A2}$ is set to "1" ($l_{A1}$ is set to "0" so that the AND gate AD 1 is closed) to open the AND gate AD 2 so that the data on the data signal line DB 1 appears on a signal line DB 3, and a black read/write signal line $l_{RW2}$ is set to "0" to write the data into the black pattern memory PCM. The contents of the dot register PR and the dot counter PC are compared, and if they are not equal, the content of the dot counter PC is incremented by one and the next 1×7-dot black pattern data is written into the memory PCM 2. The above operation is repeated until the contents of the counter PC and the register PR coincide so that the 126-byte black pattern data consisting of the black frame pattern, the reference line, the number "5" indicating the item and the space pattern, of the black-framed yellow zig-zag pattern is written into the memory PCM 2.

Figure 2:
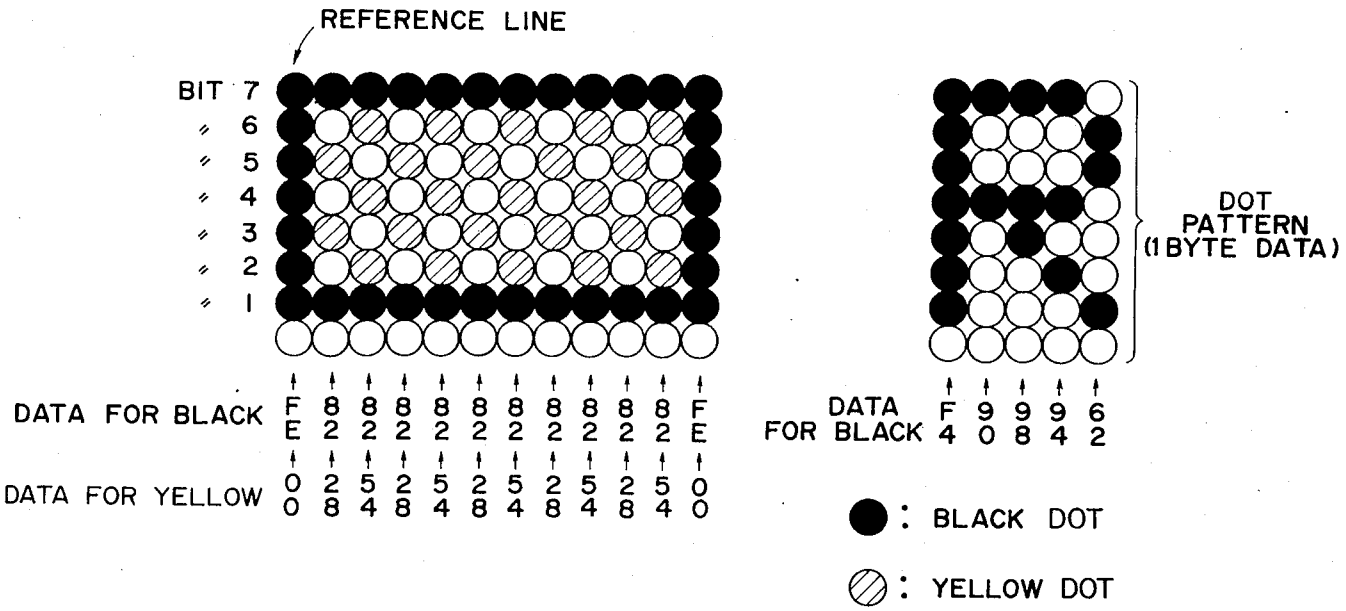
FIG. 2 illusrates a a principle of printing.

As described above, the data in the pattern memories PCM 1 and PCM 2 are stored by byte consisting of 1×7-dot data. They are dot pattern data converted by a character generator CG in the controller CC. The graph pattern is represented by the continuation of the 1×7-dot matrix and a character is represented by a 5×7-dot matrix. For example, FIG. 2 shows a 10-dot yellow graph pattern, a black frame, a reference line (the leftmost 1×7 dots) and a character R. When the 1×7-dot pattern is expressed by a hexadecimal notation with the lowermost bit being assigned to the least significant bit, the black dot pattern is expressed as FE, 82, 82, . . . 82, FE, the yellow dot pattern is expressed as 00, 54, 28, 54, 28, . . . 54, 28, 00, and the character R is expressed as 62, 94, 98, 90, F4. The solid circles in FIG. 2 indicate the black dots and hatched circles indicate the yellow dots.

Figure 3:
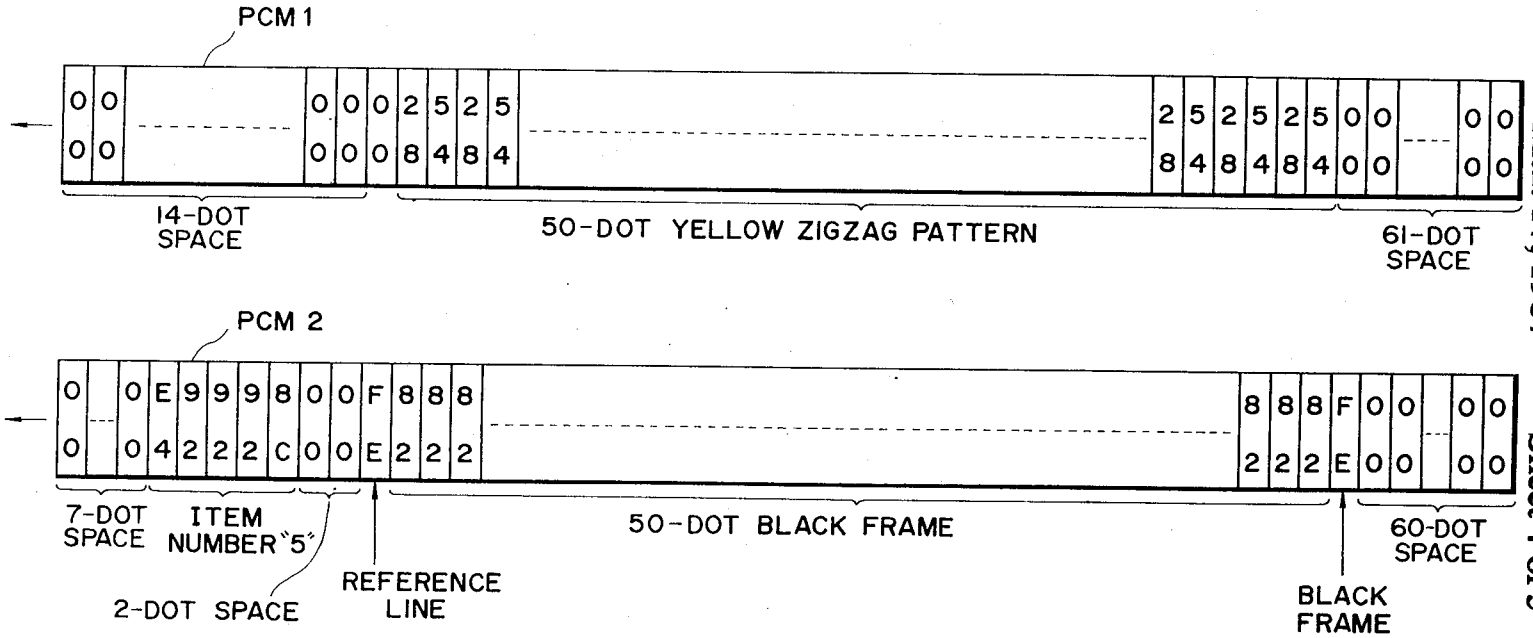
FIG. 3 shows a memory content.

In the illustrated example, the black-framed yellow zig-zag pattern, the reference line and the item number "5" are printed. The contents of the yellow pattern memory PC 1 and the black pattern memory PC 2 are shown in FIG. 3. Those data are transferred to the printer controller CC to print out the data. The print operation is explained below.

The printer feeds a paper by a pulse motor PM and has two, for example, yellow and black on-demand type piezo ink jet nozzles mounted on a carriage. The carriage is reciprocated by a DC motor DM. A piezo nozzle drive circuit PZD is activated by a carriage position sensor FDP to print the patterns or characters. The pizeo nozzle drive circuit activates piezo element PE through elecrodes EL of conventional ink jet nozzles such as the nozzle N shown in FIG. 1C.

When the pattern data have been stored in the pattern memories PCM 1 and PCM 2, the controller CC sets the black and yellow read/write signal lines sets the signal line $l_C$ to "0" to clear the dot counter PC and the line counter LC and initialize the addresses of the pattern memorise PCM 1 and PCM 2. The controller $l_{RW1}$ and $l_{RW2}$ to "1" (read) and confirms that a busy signal line $l_{BSY}$ from the printer controller PCC is 1" (non-busy state) and sets the signal line $l_{PF}$ to "1" and the signal line $l_{PB}$ to "0" to instruct the printer controller PCC to carry out the printing. In response thereto, the printer controller PCC sets the busy signal line $l_{BSY}$ to "0" (busy) and sets a drive signal line $l_F$ of the DC motor DM to "1" and sets the signal line $l_B$ to "0" to move the carriage from a home position (left position as viewed toward a print paper P) in a forward direction (right). During this period, a timing pulse from the carriage position sensor FDB is detected, and at a timing pulse immediately preceding to a print start position, the signal line $l_{BSY}$ is set to "1" to inform to the controller CC that the pattern data can be received. The controller CC sets a signal line $l_{REQ}$ to "0" to inform that the data on the data lines DP 1 and DP 2 are valid. In response to the signal $l_{REQ}$, the printer controller PCC again sets the signal line $l_{BSY}$ to "0" (busy), reads in the data of the pattern PCM 1 and PCM 2, and at the next timing pulse, memories drives the piezo nozzle drive circuit PZD by the signal lines $l_{B1}$ and $l_{Y1}$ and the nozzle carry out the black yellow printing in accordance with the most significant bit state 1×7 dots. In the present example, since the yellow and black data are both "0" as shown in FIG. 3 the space is printed. After the printing, the signal line $l_{BSY}$ is printed. After the printing, the signal line $l_{BSY}$ is set to "1" to inform to the controller CC that the next pattern data can be received. The controller CC increments the dot counter PC by one of the signal line $l_{PC}$ to increment the address to the pattern memories by one so that the next data are read out to DP 1 and DP 2. It also sets the signal line $l_{REQ}$ to "0" to inform that the data on the data lines DP 1 and DP 2 are valid. The printer controller PCC reads in the data of the pattern memories PCM 1 and PCM 2 and prints them out at the next timing pulse.

In a similar manner, the data of FIG. 3 printed in the direction of the arrow for the most significant dot of the 1×7-dot yellow and black pattern data (because only one yellow nozzle and only one black nozzle are provided). The content of the dot counter PC which is incremented by one for each printing and the content of the dot register PR are compared by the comparator CO, and when they coincide, the controller CC determines the end of the 126-dot print and resets the dot registor PR to "0" by the signal line $l_{PR}$, sets the signal line $l_{PF}$ to "0" and sets the signal line $l_{PB}$ PF to "1".

The printer controller PCC sets the busy signal line $l_{BSY}$ to "0", the DC motor signal line $l_f$ to "0" and the signal line $l_B$ to "1" to drive the carriage in the reverse direction to start the printing in the reverse direction. It also drives the paper feed pulse motor PM to feed the paper by one dot pitch. As in the forward printing, the busy signal line $l_{BSY}$ is set to "1" at the timing pulse immediately preceding to the print position to inform to the controller CC that the pattern data can be received. The controller CC sets the signal line $l_{REQ}$ to "0" to inform that the first data or the 126th dot data in the reverse printing is valid. The printer controller PCC receives the pattern data and prints it out at the next timing pulse and sets the busy signal line $l_{BSY}$ to "1" to inform that the next pattern data can be received. The controller CC decrements the dot counter PC by one by the signal line $l_{BC}$ because the printing is now in reverse direction, and decrements the memory address by one to read out the 125th data on the data lines PD 1 and PD 2, and sets the signal line $l_{REQ}$ to "0" and prints the data at the next timing pulse. In a similar manner, the second line dot data of the 1×7-dot yellow and black data are reverse-printed until the first dot data is printed. When the comparator CO detects the coincidence of the number of dots, the controller CC increments the line counter LC by one by the signal line $l_1$. The output signal line $l_2$ of the line counter LC is used to detect the end of four times of reciprocation of the carriage. Since one time of reciprocation has just finished, no signal is produced on the signal line $l_2$. The content of the dot register PR is set to "125" and the signal line $l_{PF}$ is set to "1" and the signal line $l_{PB}$ is set to "0" to instruct the printing of the third line of the 1×7 dots. The printer controller PCC sets the busy signal line $l_{BSY}$ to "0", feeds the paper by one dot pitch by the paper feed pulse motor PM, sets the drive signal line $l_F$ of the DC motor DM to "1" and sets the signal line $l_B$ to "0" to carry out the forward printing. When the comparator CO detects the coincidence, the reverse printing is started.

Figure 4:
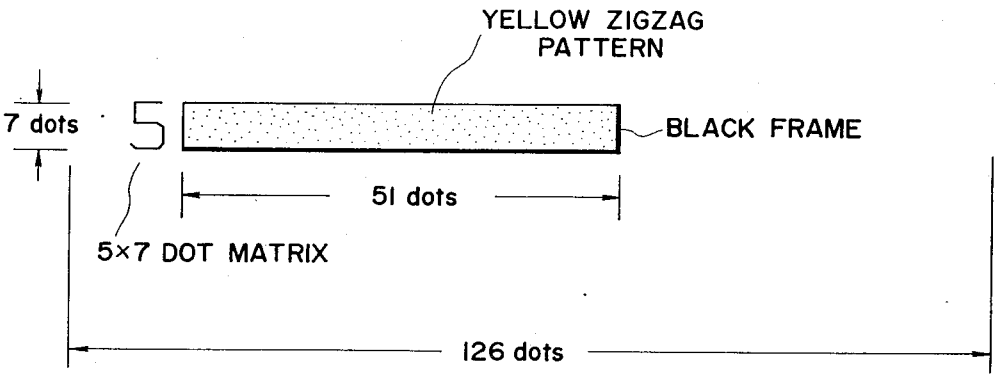
FIG. 4 shows a print example.

In a similar manner, four times of reciprocative printing is carried out. At the end of the four times of reciprocation, the line counter LC produces the output on the signal line $l_2$ to inform that the 126 1×7-dot patterns have been printed. Thus, the printing of the black-framed yellow zig-zag pattern, the reference line and the item number "5" has been completed. The printout is shown in FIG. 4.

As described hereinabove, by framing the graph pattern of a hard-to-distinguish color by the pattern of other color, the graph pattern can be readily distinguished and hence business efficiency and productivity can be improved.

What I claim is:

1. Recording apparatus for accepting pattern infomration data, the apparatus comprising:

pattern-producing means for recording on a medium in a designated color a visible pattern corresponding to the pattern information;

detecting means responsive to said pattern-producing means for generating a detection signal when the designated color is a predetermined color, the predetermined color being a color which provides poor contrast with the recording medium and requires a contrasting color frame;

frame-information-forming means responsive to the detection signal for providing frame information; and frame-producing means responsive to the frame information for recording on the medium a visible frame of the contrasting color around the pattern.

2. Recording apparatus according to claim 1, wherein the predetermined color is yellow and said frame-producing means records a black frame around the yellow pattern.

3. Recording apparatus according to claim 1, wherein said pattern-producing means and said frame-producing means include ink jet nozzles.

4. Recording apparatus for accepting pattern information data representing an unframed pattern to be recorded in a color designated from a plurality of colors, the apparatus comprising:

pattern-producing means for recording the unframed pattern on a medium in the designated color in response to the pattern information data;

detecting means responsive to said pattern-producing means for generating a detection signal when the designated color is a predetermined color, the predetermined color being a color which provides poor contrast with the recording medium and requires a contrasting color frame;

frame-information-generating means responsive to the detection signal for generating frame information data which was not included in the pattern information data; and frame producing means responsive to the frame information for recording on the medium a frame around the pattern in the contrasting color to provide contrast between the pattern and the recording medium.

5. Recording apparatus according to claim 4, wherein the predetermined color is yellow and said frame-producing means records a black frame around the yellow pattern.

6. Recording apparatus according to claim 4, wherein said pattern-producing means and said frame-producing means include ink jet nozzles.

* * * * *

UNITED STATES PATENT AND TRADEMARK OFFICE

CERTIFICATE OF CORRECTION

PATENT NO. : 4,651,175

DATED : March 17, 1987

INVENTOR(S) : SHIGEMITSU TAZAKI

It is certified that error appears in the above-identified patent and that said Letters Patent is hereby corrected as shown below:

AT [54] IN THE TITLE

"PRINTER" should read --MULTI-COLOR PRINTER WITH FRAME PRODUCING MEANS

AT [57] IN THE ABSTRACT

Lines 2, "which," should read --which--.

COLUMN 1

Line 14, "of" should be deleted.
Line 36, "the" should be deleted.
Line 45, "other" should read --another--.
Line 51, "nozzle." should read --nozzle,--.
Line 52, "illusrates a a" should read --illustrates a--.
Line 60, "Printing a" should read --Printing of a--.

COLUMN 2

Line 3, "pattern a" should read --pattern of a--.
Line 5, "designated, pattern of a " should read --pattern of a designated,--.
Line 17, "$l_{Ad}$" should read --$l_{AD}$--.
Line 22, "$l_{Rw}$" should read --$l_{RW}$--.
Line 29, "The above The above" should read --The above--.
Line 42, "PCM." should read --PCM2.--.

COLUMN 3

Line 17, "elecrodes" should read --electrodes--."

UNITED STATES PATENT AND TRADEMARK OFFICE

CERTIFICATE OF CORRECTION

PATENT NO. : 4,651,175

DATED : March 17, 1987

INVENTOR(S) : SHIGEMITSU TAZAKI

It is certified that error appears in the above-identified patent and that said Letters Patent is hereby corrected as shown below:

COLUMN 3

Line 20, "sets the" should be deleted.
Line 21, "black and yellow read/write signal lines" should be deleted.
Line 24, "memorise" should read --memories--.
Line 24, "controller $l_{RW1}$" should read --controller CC sets the black and yellow read/write signal lines $l_{RW1}$--.
Line 44, "pattern PCM1" should read --pattern memories PCM1--.
Line 45, "memories" should be deleted.
Line 46, "nozzle" should read --nozzles--.
Line 47, "black yellow" should read --black/yellow--.
Line 48, "state 1x7" should read --state of the 1x7--.
Line 50, "FIG. 3 the" should read --FIG. 3, the--.
Line 50, "After the printing, the signal" should be deleted.
Line 51, "line $l_{BSY}$ is printed" should be deleted.
Line 54, "of" should read --by--.
Line 62, "FIG. 3 printed" should read --FIG. 3 are printed--.

COLUMN 4

Line 3, "registor" should read --register--.
Line 4, "$l_{PB}$" should read --$l_{PB}$ to "1".--.
Line 5, "PF to "1"." should be deleted.
Line 60, "infom-" should read --infor- --.
Line 61, "ration" should read --mation--.

UNITED STATES PATENT AND TRADEMARK OFFICE

CERTIFICATE OF CORRECTION

PATENT NO. : 4,651,175

DATED : March 17, 1987

INVENTOR(S) : SHIGEMITSU TAZAKI

It is certified that error appears in the above-identified patent and that said Letters Patent is hereby corrected as shown below:

COLUMN 6

Line 11, "frame producing" should read --frame-producing--.

Signed and Sealed this

Fifteenth Day of September, 1987

*Attest:*

DONALD J. QUIGG

*Attesting Officer*

*Commissioner of Patents and Trademarks*